US008988303B1

(12) United States Patent
Apostolos et al.

(10) Patent No.: US 8,988,303 B1
(45) Date of Patent: Mar. 24, 2015

(54) EXTENDED PERFORMANCE SATCOM-ORIAN ANTENNA

(75) Inventors: John T. Apostolos, Lyndeborough, NH (US); Judy Feng, Nashua, NH (US); William Mouyos, Windham, NH (US)

(73) Assignee: AMI Research & Development, LLC, Windham, NH (US)

( * ) Notice: Subject to any disclaimer, the term of this patent is extended or adjusted under 35 U.S.C. 154(b) by 489 days.

(21) Appl. No.: 13/404,626

(22) Filed: Feb. 24, 2012

Related U.S. Application Data

(60) Provisional application No. 61/446,138, filed on Feb. 24, 2011.

(51) Int. Cl.
*H01Q 21/26* (2006.01)
*H01Q 21/00* (2006.01)
*H01Q 3/24* (2006.01)

(52) U.S. Cl.
USPC ..... 343/797; 343/853; 343/876

(58) Field of Classification Search
CPC ..... H01Q 3/30; H01Q 3/34; H01Q 3/40; H01Q 9/0428; H01Q 9/045; H01Q 9/0471; H01Q 25/00; H01Q 25/01; H01Q 1/36; H01Q 11/14; H01Q 7/00; H01Q 9/42; H01Q 9/0421; H01Q 9/28; H01Q 9/36; H01Q 21/24; H01Q 21/26; H01Q 21/30; H01Q 21/205; H01Q 21/29
See application file for complete search history.

(56) References Cited

U.S. PATENT DOCUMENTS

| | | | | |
|---|---|---|---|---|
| 4,121,216 | A | 10/1978 | Bunch et al. | |
| 5,023,576 | A * | 6/1991 | Staudinger et al. | 333/118 |
| 6,373,446 | B2 | 4/2002 | Apostolos | |
| 6,690,331 | B2 * | 2/2004 | Apotolos | 343/744 |
| 6,888,510 | B2 | 5/2005 | Jo et al. | |
| 7,436,369 | B2 | 10/2008 | Apostolos | |
| 7,505,009 | B2 | 3/2009 | Parsche et al. | |
| 7,623,075 | B2 * | 11/2009 | Apostolos | 343/700 MS |
| 7,852,276 | B2 | 12/2010 | Apostolos | |

* cited by examiner

*Primary Examiner* — Hoang V Nguyen
*Assistant Examiner* — Patrick Holecek
(74) *Attorney, Agent, or Firm* — Cesari and McKenna, LLP

(57) ABSTRACT

An orientation independent antenna apparatus using a six sided conductive structure and triangular elements on a selected surface thereof, to provide both horizontal and vertical polarization mode feeds. In one implementation, a vertical coupling element is disposed within the structure so that four perpendicular surfaces are parasitically coupled to provide the vertical polarization mode. In other implementations, coaxial cable(s) may be used with a ferrite core and/or combiner circuits to provide the horizontal mode feed.

14 Claims, 7 Drawing Sheets

EXTENDED PERFORMANCE SATCOM-ORIAN ANTENNA

RELATED APPLICATION

This application claims the benefit of U.S. Provisional Application No. 61/446,138, filed on Feb. 24, 2011. The entire teachings of the above application(s) are incorporated herein by reference.

BACKGROUND

In certain applications of radio communications it is important to be able to robustly communicate without knowing the relative orientation of the transmit and receive antennas in advance. For example, in the case of communication from a satellite to a terrestrial vehicle, as the vehicle moves about the terrain (or even within a building), signals arrive at the antenna on the vehicle with a variety of different polarizations from different directions. If the vehicle uses, for example, a simple vertical dipole, one obtains 360° coverage but only for vertically polarized signals. Such a vertical dipole is relatively insensitive to horizontally polarized signals.

Many antennas mounted on vehicles also take the form of a mast that may be purposely flexible so that if the antenna hits an object it will bend and not snap or break. Antennas formed with flexible masts thus have their vertical and/or horizontal orientation direction altered by the flexibility of the mast, meaning that reliable communication cannot always be established if the polarization direction of the antenna is not exactly aligned with that of the transmitter. In short, it is often the case that as the vehicle moves throughout an environment its antenna may tilt at various angles and therefore compromise communications with either a terrestrial base station or a satellite.

It is known that an Orientation-Independent Antennas (ORIAN) can be formed from crossed vertical loops in combination with a horizontal loop. This arrangement may provide circular polarization in a hemisphere surrounding the antenna such that signals are robustly received regardless of their polarization or angle of arrival. The antenna can be a free standing antenna.

One such ORIAN antenna is in the form of a cube with the various loops implemented as triangular shaped antenna elements disposed on the surfaces of the cube. Such antennas are described in further detail in U.S. Pat. No. 7,852,276 by Apostolos, et al., entitled "Orientation-Independent Antenna (ORIAN)" issued Dec. 14, 2010, and U.S. Pat. No. 7,623,075 by Apostolos, et al. entitled "Ultra Compact UHF SATCOM Antenna" issued Nov. 24, 2009, the entire contents of each of which are hereby incorporated in their entirety.

SUMMARY

In one embodiment herein a compact orientation independent (ORIAN) antenna is provided having four triangular shaped elements positioned on or formed in at least one surface of a cube or other six-sided structure. The other surfaces of the cube may be formed of metal plates which may themselves have other types of triangular or other conductive elements. In a preferred arrangement, the triangular antenna elements are formed on a bottom face of the cube and fed at the intersection of the four triangles using a phasing network. The phasing network combines the four elements to provide Right Hand (and/or Left Hand), circularly polarized outputs as well as a vertically polarized (V-POL) output.

As a result, at low angles of arrival such as from satellites near the horizon, when the horizontal component of the circularly polarized wave is diminished in amplitude, then the vertically polarized line of sight mode is chosen. A switch may provided to select the mode that is best to use at periodic intervals. One mode or the other can therefore be determined by receiver circuits for example, that detect signal power in modes that operate the switch to select the mode that provides the better performance under current conditions.

The phasing network may itself take several different forms. In one implementation, this can be a pair of 180° combiners. The first pair of 180° combiners is coupled to a first selected pair of the triangular elements; and a second 180° combiner couples to the other pair of triangular elements. The plus or positive (in phase) outputs of the combiners are each fed to a summing network to provide the vertical polarization (V-POL) output. The negative or out of phase outputs of the 180° combiners are fed to a quadature combiner to provide the Right Hand (RH) and Left Hand (LH) circularly polarized (C-POL) outputs.

In yet another embodiment, the phasing network may take the form of a centrally located vertical coupling element and a ferrite core. In this embodiment, the centrally located vertical coupling element is disposed inside the center of the cube is located at an electric field null of the right hand (RH) and/or left hand (LH) feeds. cables are coupled to the triangular elements such that a first coaxial cable feeds one of the triangular elements at a center conductor and a shield of the coaxial cable feeds the opposite triangular element. A second coaxial cable is similarly fed from opposing triangular elements at respective center and shield conductors. The coaxial cables are wrapped around the ferrite core; the result is electrically equivalent to the pair of 180° combiners in the earlier described embodiment but at a much lower cost and compact size. The two coaxial cables then feed a quadrature combiner to provide the Right Hand and Left Hand circularly polarized feeds.

The vertically polarized signal is provided by the centrally located vertical coupling element which excites currents in the metal plates on the other side of the cubes. In this mode, the metal sides of the cube operate as parasitic elements to provide the vertically polarized signal.

In yet another arrangement suitable for vertical polarization cases only, low angle of arrival or line of sight communications can be optimized the providing all four quadrant beams simultaneously. In this arrangement, the triangular elements are again fed to a pair of 180° combiners. The sum and difference outputs of the 180° combiners are fed to a respective pair of 90° quadrature combiners. These then provide the four independent quadrant beams simultaneously.

BRIEF DESCRIPTION OF THE DRAWINGS

The foregoing will be apparent from the following more particular description of example embodiments, as illustrated in the accompanying drawings where like reference characters refer to the same parts throughout different views. The drawings are not necessarily to scale, emphasis instead being placed upon illustrating example embodiments.

DETAILED DESCRIPTION

Figure 1:
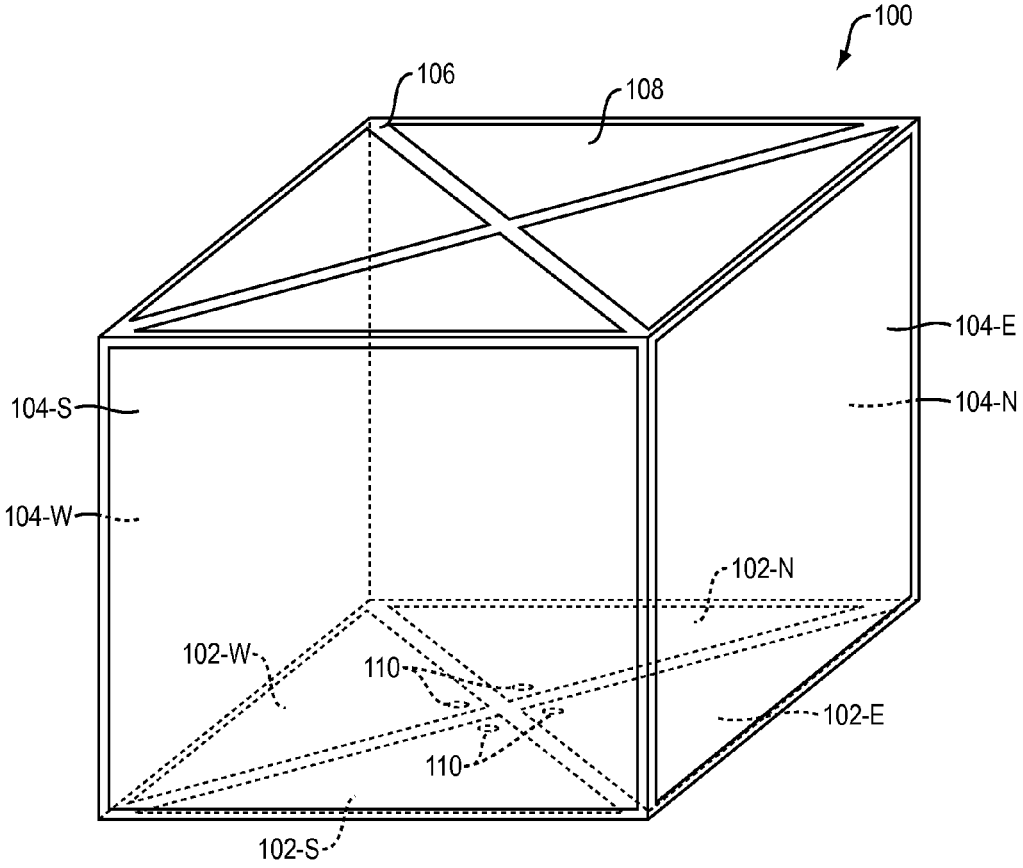
FIG. 1 illustrates a general structure of a cube having four triangular shaped antenna elements on a bottom surface thereof, one metallic elements on four sides thereof, and optional triangular elements on a top surface thereof.

The general structure of a compact ORIAN antenna (Suitable for Satellite Communications) is shown in FIG. 1. Four triangular elements 102 are positioned on or formed in at least the bottom surface 101 of a six-sided structure which may be a cube 100. In a preferred embodiment, the triangular antennas are fed at the intersection of the four triangular elements as will be described in more detail below.

More specifically, the four triangular elements may be considered to have (for the sake of identification only) an east 102-E, south 102-S, west 102-W and north 102-N position on the bottom face of cube 100. These elements are formed from a conductive material on a dielectric substrate. The four corresponding vertical faces of cube 100 (faces 104-E, 104-S, 104-W, 104-N) are also formed of conductive material on a substrate. The substrates may physically isolate the conductive surfaces on the six sides from one another such that a dielectric gap is formed between and along the corners and the edges of the cube 100. In specific arrangements discussed, herein the top face of the cube 106 may also have additional parasitic triangular elements 108 formed thereon. A pair of the elements 102-E and 102-W are disposed opposite and orthogonal to each other, and a second pair 102-N, 102-S are similarly opposite and orthogonal to each other.

It should be understood that reference to the letters ("E"), ("S"), ("W"), and ("N") herein are meant herein to merely identify particular surfaces and/or antenna elements and are not meant to imply that the cube must be oriented with respect to the terrain in any particular way; in fact, it is a fundamental aspect that the cube 100 provides an orientation independent (ORIAN) antenna. It should be understood that the term "cube" is used herein to generally refer to structures with six faces, and that all faces of cube 100 need not be exactly the same size.

Corresponding feed points 110 are associated with each of the triangular elements 102. These feed points are preferably located adjacent a point in the middle of the cube bottom surface 101 of cube 100 where the triangular elements come together.

Figure 2:
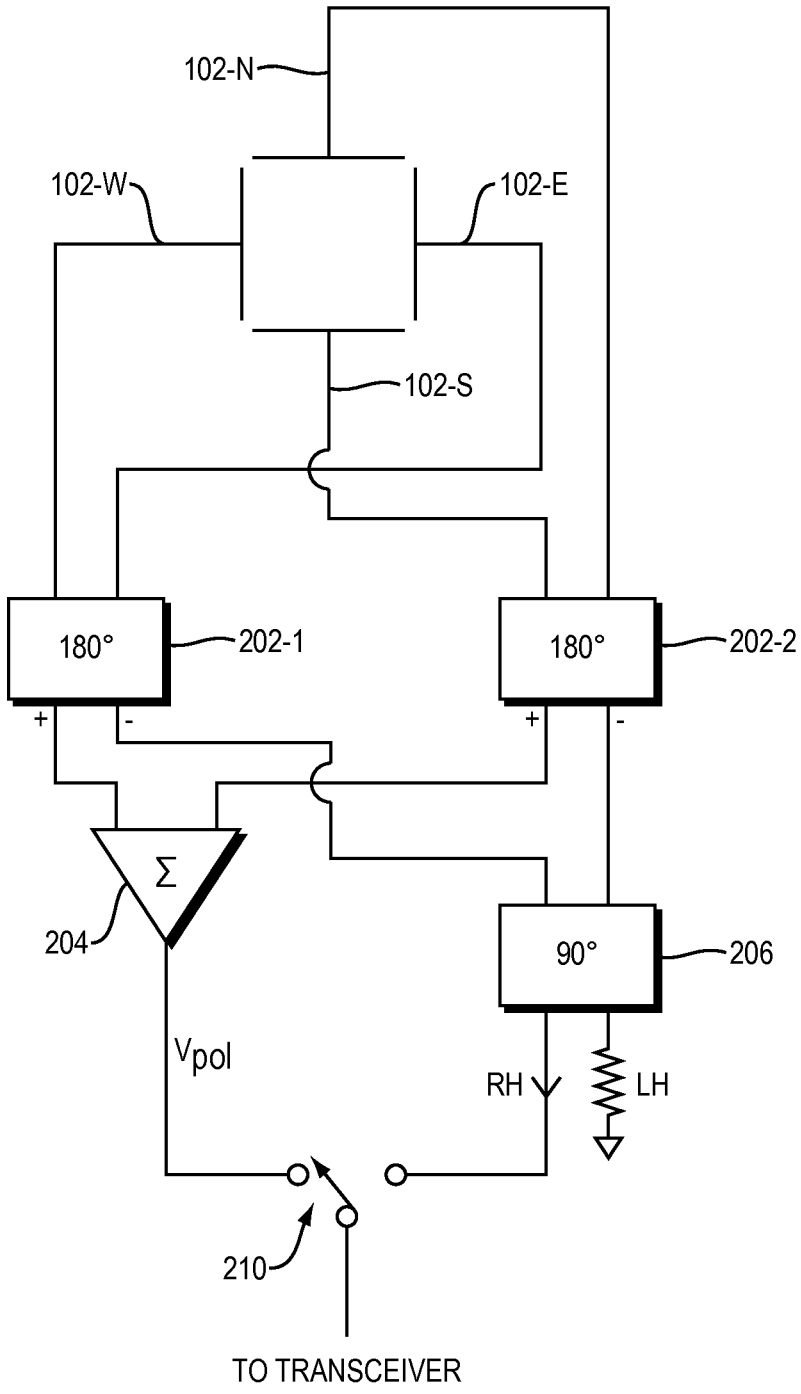
FIG. 2 illustrates a phasing network that may be used to combine the four bottom triangular elements to provide a Right Hand (RH) circularly polarized (V-POL) output and a vertically polarized (V-POL) output.

FIG. 2 is one example of a phasing network combining the 102-E, 102-S, 102-W, and 102-N elements to provide both a right hand circularly polarized (RH, C-POL) output and a vertically polarized (V-POL) output. As shown in FIG. 2, a first pair of triangular elements such as 102-W and 102-E are coupled to a first 180° combiner 202-1; the other pair of triangular elements, 102-S and 102-N, are coupled to a second 180° combiner 202-2. The plus (or sum) outputs of each of the 180° combiners 202 are connected to a summing network 204 to provide the vertically polarized (V-POL) output. The minus or difference outputs of the 180° combiners 202 are connected to a quadrature combiner 206. The outputs of the quadrature combiner 206 then provides respective Right Hand (RH) and Left Hand (LH) circularly polarized (C-POL) feed points. As illustrated, it may be the case that for example, only a Right Hand (RH) polarized feed is of interest and thus only it is fed to switch 210. The Left Hand (LH) output is thus fed to a dummy load in this instance.

The switch 210 thus allows selection of the VPOL or RH-CPOL mode depending upon the desired mode of operation. At low angles of arrival (AOA), such as from satellites located near the horizon, the horizontal component of the RH C-POL mode is diminished in amplitude due to earth losses. Better signal to noise ratio (SNR) may be possible if all the power is switched to select the vertically polarized (V-POL) line of sight (LOS) mode in this condition. However, for overhead satellites, the RH C-POL mode is preferred.

Decision logic can be used to pick the best mode and set the switch 210 at periodic intervals. One mode or the other can be determined by another circuit (not shown) that detects receiver/signal power in each of the two modes, and then operates the switch 210 to select the mode that provides the better performance.

Figure 3:
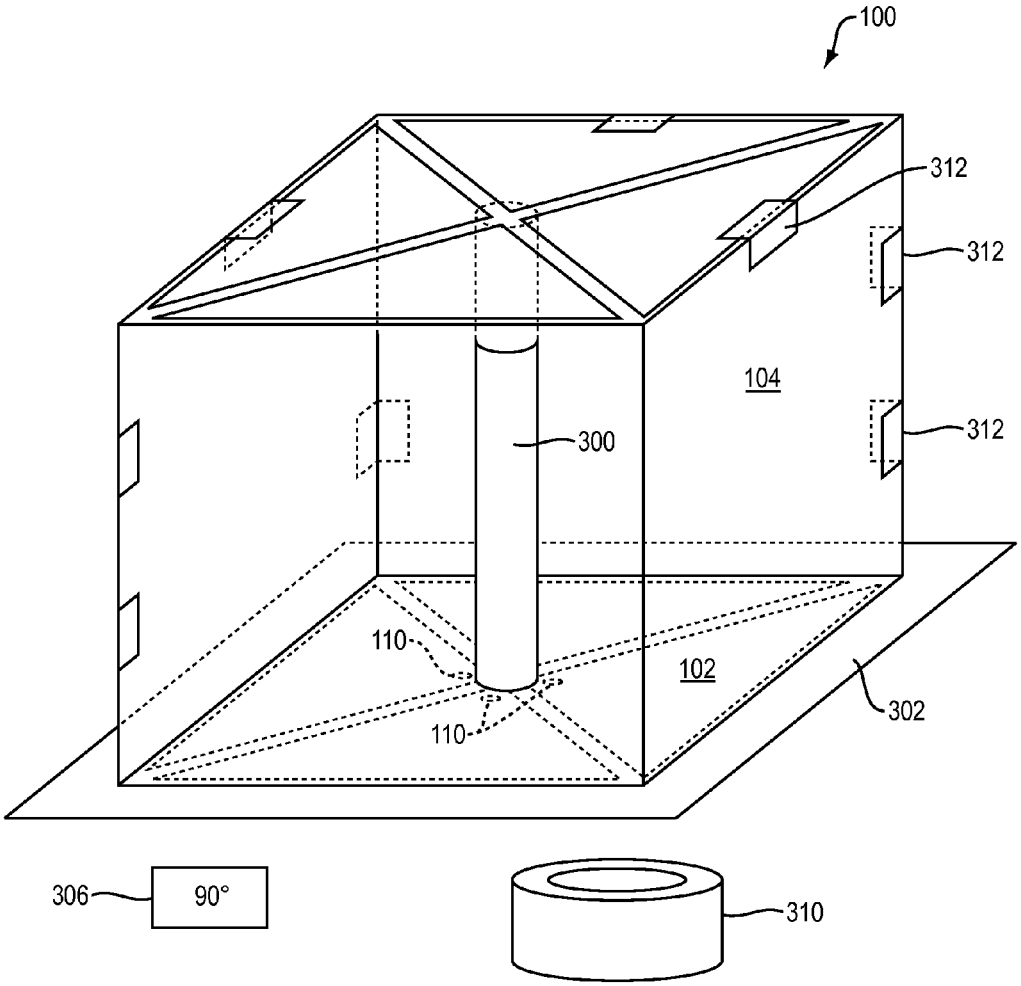
FIG. 3 is another implementation providing a similar function as the circuit of FIG. 2 but with a centrally located vertical coupling element and ferrite core.

FIG. 3 is another implementation that achieves the same results, that is the ability to provide both vertical polarization (V-POL) and right hand circular polarization (RH-C-POL) outputs using the same six-sided structure 100. This implementation uses a centrally located vertical coupling element 300, ferrite core 310 and ground plane 202. The view of FIG. 3 is of the cube 100 with one of the faces (that is, the front face 102-S) removed so that the interior of the cube 100 can be seen in more detail. The bottom face 101 of the cube 100 is arranged as in FIG. 1 with a set of four triangular elements. The metal sides 104 are also provided as in the previous explained embodiment of FIG. 1.

However, in the implementation of FIG. 3 there is provided a centrally located vertical coupling element 300 which may take the form of a tube having conductive surface. The vertical coupling element 300 is disposed in the center of the cube 100. This location, in center of the cube 100, is at or near an electric field null of the circularly polarized triangular elements 102. The result is that operation of the centrally located vertical coupling element 300 does not effect operation of the right hand/left hand circular polarization modes.

The center fed vertical coupling element 300 excites currents in the metal sides 104 to produce the V-POL pattern. This excitation is therefore parasitic; in other words, the vertical coupling element 300 acts to excite currents on all four sides 104 of the cube 100 being physically connected to the sides 104.

In specific embodiments herein, patches 312 may provide an impedance between the each of the sides 104 and a respective one of the adjacent sides 104. The impedances 312 may include matching and/or balancing impedances, such as through various combinations of capacitive and/or inductive elements. Selection of impedances can result in improving match across a particular radio frequency band of interest and relative immunity of input impedances from proximity to the vehicle platform.

As further illustrated herein, if the top surface 106 is also provided with triangular elements 108, additional conductive patches 312 provide conductivity between each top triangular element and its respective adjacent one of the sides. In this way, the top triangular elements also become part of the structure parasitically fed by the centrally located vertical coupling element 300.

Figure 4A:
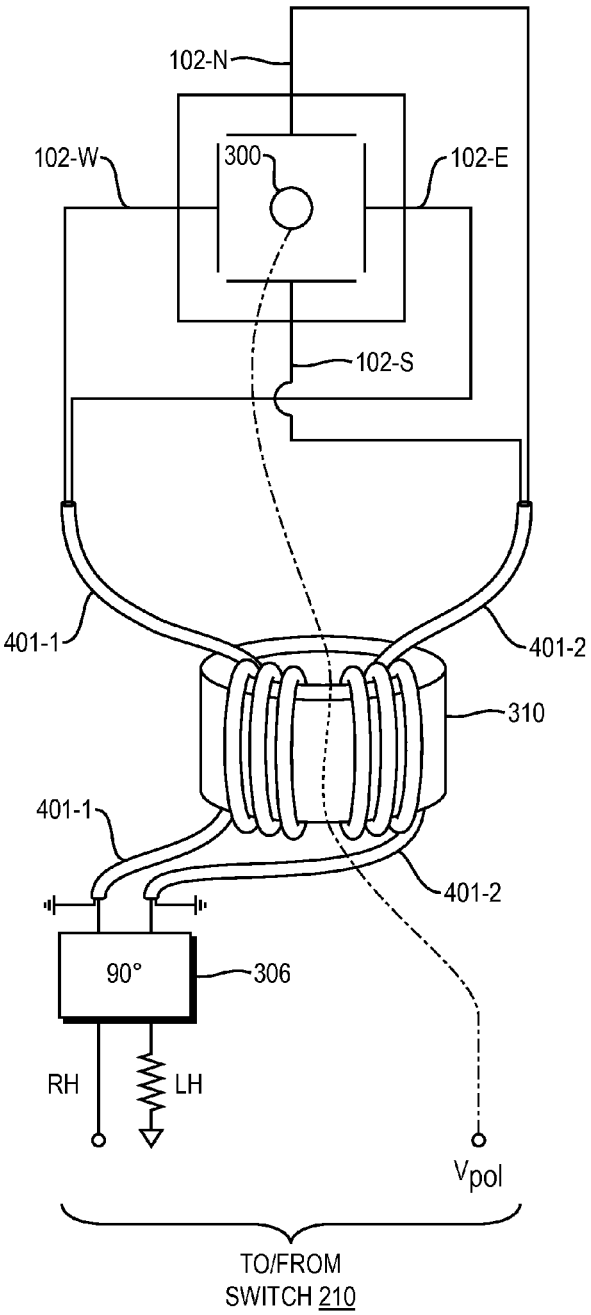
FIG. 4A and FIG. 4B are an electrical diagram corresponding to the embodiment of FIG. 3 showing the connection of the triangular elements to the ferrite and how the vertically polarized output is provided to the centrally located coupling element.

FIG. 4A is an electrical diagram showing the connection of elements corresponding to the structure of FIG. 3. The top part of the figure is a schematic view of the cube 100 looking from above, showing the centrally located vertical coupling element 300 and the four triangular elements 102-E, 102-S, 102-W and 102-N formed on the bottom surface thereof, as well as ground plane 302. An opposite pair of the triangular elements, such as elements 102-E and 102-W, are coupled to a first coaxial cable 401-1. One of these elements 102-E is coupled to the center conductor of coaxial cable 401-1 and the other element 102-W is coupled to the shield of coaxial cable 401-1. A second coaxial cable 401-2 feeds the other two opposing triangular elements 102-N, 102-S. One of the elements 102-N is coupled to a center conductor of cable 401-2 with the other element 102-S coupled to the shield.

The coaxial cables 401-1 and 401-2 are each wrapped around a ferrite core 310 as shown. Typically, only a few windings are required around the ferrite 310. The center conductor of coaxial cables 401-1 and 401-2 are then fed to respective inputs of a hybrid 90° combiner 306, and the respective shields are grounded nearby or on combiner 306. The hybrid 90° combiner 306 provides the Right Hand (RH) and Left Hand (LH) circularly polarized (C-POL) feeds.

Figure 4B:
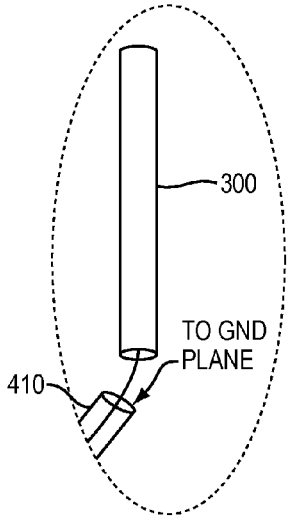

The vertical polarization feed is directly from the centrally located vertical coupling element 300. The detail shown in FIG. 4B illustrates the element 300 embodied as a metallic surface tube, with for example, the center conductor of the cable 410 being coupled to the metal surface of the tube and the shield of cable 410 being coupled to the ground plane 302. The cable 410 then directly provides the vertical polarized (V-POL) feed. In preferred embodiments, this coaxial cable 410 can be routed straight through the center of the ferrite 310 core or in other ways.

Figure 5:
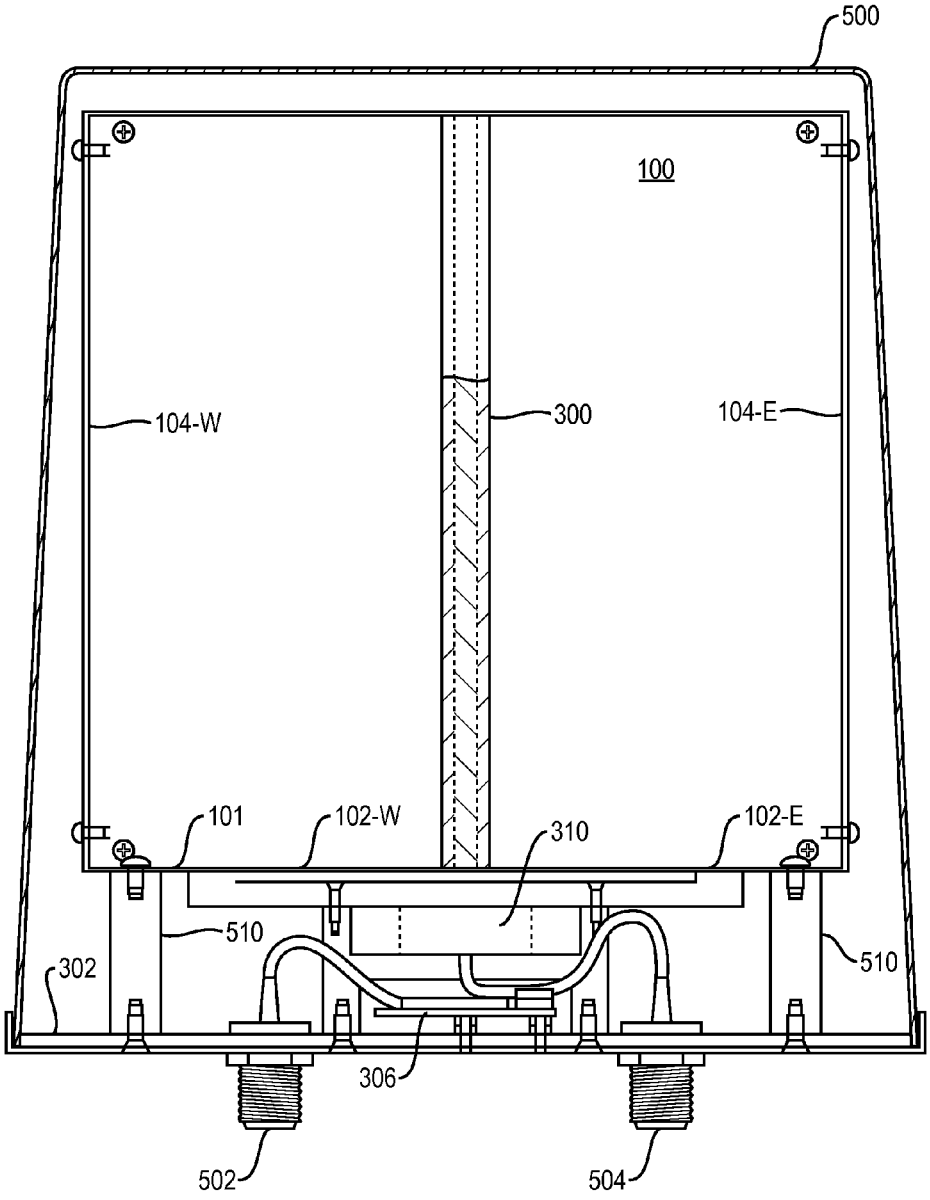
FIG. 5 is a cross sectional view of the implementation of FIG. 3 showing the location of the centrally located vertical coupling element ferrite and quadrature combiner in more detail.

FIG. 5 is a cross sectional view of the embodiments of FIGS. 3, 4A and 4B taken in a plane through the center thereof. A cover or radome 500 protects the cube 100 from the elements is shown. The centrally located vertical coupling element 300 is shown in orientation with respect to the east face 104-E and west face 104-W of the cube 100. The ferrite 310 may be mechanically supported beneath the bottom surface 101 of the cube, and a stand-off may also support the hybrid combiner 106 in a convenient location. The Right Hand Circularly Polarized (RH C-POL) 502 and V-POL 504 feeds are via BNC connectors. Other stand offs 510 may support the cube 100 above ground plane 302.

Figure 6:
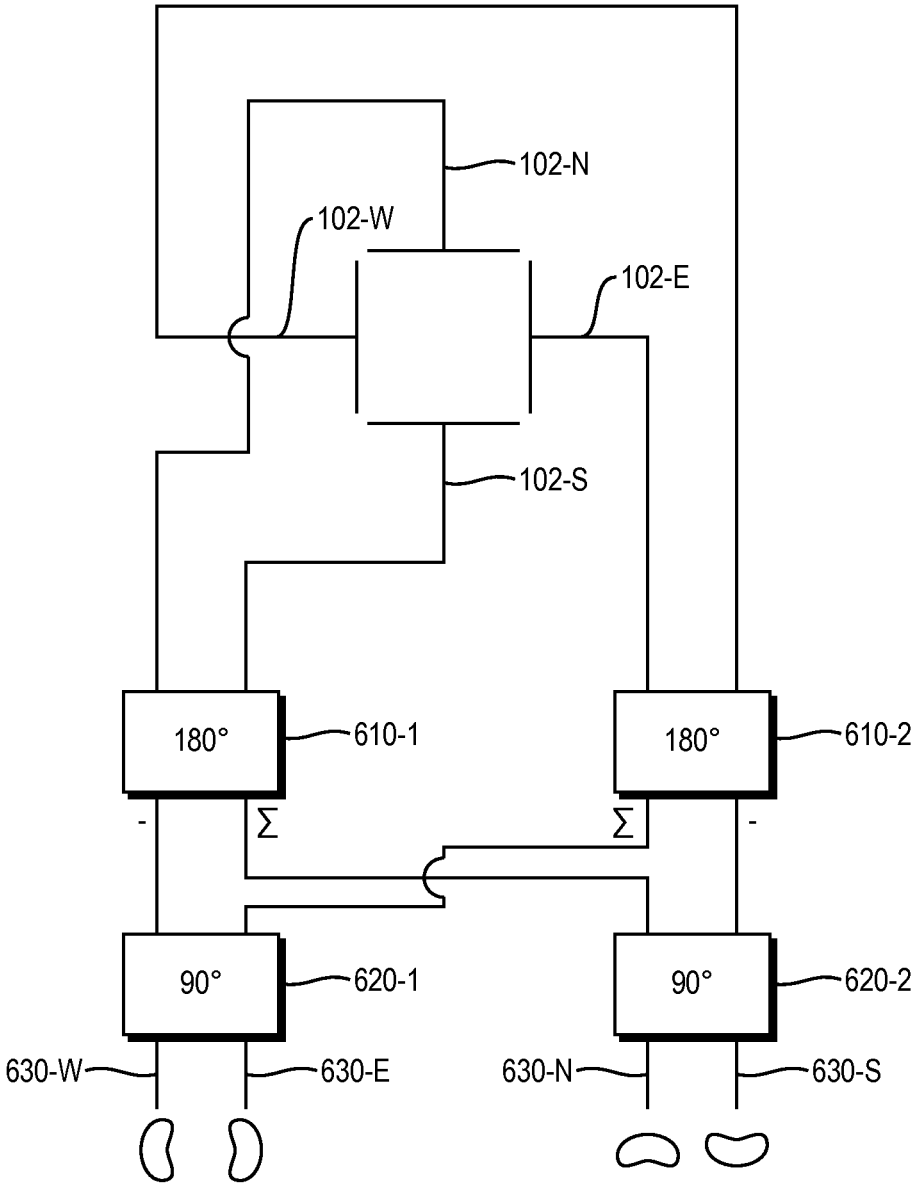
FIG. 6 is a general diagram illustrating how simultaneous quadrant line of sight (LOS) beams can be provided with the same antenna structure.

The phasing network of FIG. 6 can be used with the same cube 100 to simultaneously generate four quadrant beams. This arrangement provides 4-5 dB more gain than the omnidirectional Line of Sight (LOS) (V-POL) mode.

This arrangement of combiners provides simultaneous reception of all four directions. The opposite triangular elements such as 102-N, 102-S are coupled to respective ports of the first 180° combiner 610-1. A second 180° combiner 610-2 feeds the other two opposing triangular elements, 102-E, 102-W. The sum (or positive) port of 180° combiner 610-2 and negative (or difference) port of 180° combiner 610-1 are coupled to respective inputs of quadrant combiner 620-1. Quadrature combiner 620-1 thus provides a respective west oriented beam 620-W and an east oriented beam 620-E. Similarly, quadrature combiner 620-2 is fed from the sum port of 180° combiner 610-1 and difference port of 180° combiner 610-2 to provide north facing beam 630-N and south facing beam 630-S. The respective beams can be fed, for example, to and from a transceiver or simultaneous and/or combined in various ways to provide orientation independent operation.

Figure 7:
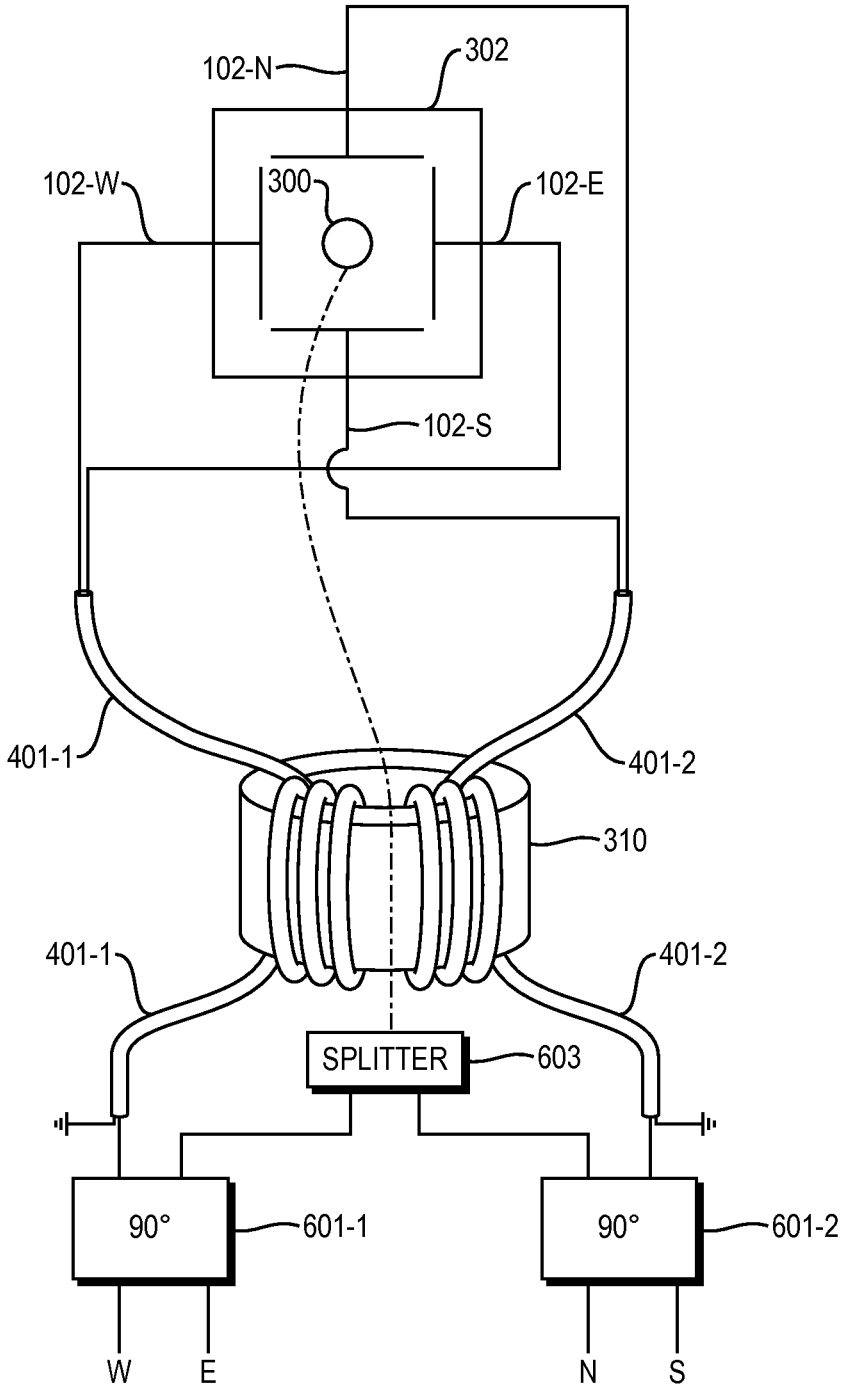
FIG. 7 is a simultaneous quadrant implementation using a ferrite and quadrature combiners.

FIG. 7 illustrates how four simultaneous beams can be generated using a ferrite 310 and coaxial cables 401-1, 401-2. The connection between the antenna elements 102, center vertical element 300 and ferrite 310 are similar to that of FIG. 4A, but here the center conductors of coaxial cables 401-1, 401-2 are each fed to a respective 90° combiner 601-1, 601-2. The centrally located vertical element 300 couples to a splitter 603 to provide the other input to each combiner 601-1, 601-2. The combiners provide the W, E and N, S beams independently.

While this invention has been particularly shown and described with references to example embodiments thereof, it will be understood by those skilled in the art that various changes in form and details may be made therein without departing from the scope of the invention encompassed by the appended claims.

What is claimed is:

1. An orientation-independent antenna apparatus comprising:

a first pair of triangular elements positioned opposite to one another;

a second pair of triangular elements positioned opposite to one another and co-planar to the first pair of triangular elements;

the apparatus farther including a six sided structure with the first and second pair of elements disposed on a selected surface of the six sided structure, and with four of the six sides being disposed adjacent and perpendicular to the selected surface;

a vertical coupling element disposed within the six sided structure, arranged to parasitically feed the four of the six sides that are disposed perpendicularly to the selected surface having the triangular elements; and a phasing module for selectively combining the first and second pair of triangular elements for at least two polarization modes, with a first element of each pair providing a first combined signal, and with a second element of each pair providing a second combined signal, and such that in a first polarization 90 degrees from one another to provide a circularly polarized feed, and such that in a second polarization mode, the first and second combined signals are further combined together to provide vertically polarized feed.

2. The apparatus of claim 1 additionally comprising a switch, for selectively choosing either the circularly polarized mode or the vertically polarized mode as a primary feed for the antenna.

3. The apparatus of claim 1 wherein the phasing module further comprises:

a first combiner for combining the first and second pair of triangular elements with a 180° phase shift there between; and a second combiner producing the second combined signal from the second element of each pair with the 180° phase shift there between.

4. The apparatus of claim 1 wherein the phasing module further comprises:

a ferrite core; and a first coaxial cable connected to selected elements of the first and second pair of triangular elements;

a second coaxial cable connected to other selected elements of the second pair of triangular elements; and such that the first and second coaxial cables are each wound around the ferrite core to produce the respective first and second combined signals.

5. The apparatus of claim 1 additionally comprising:

a third pair of triangular elements positioned orthogonal to one another; and a fourth pair of triangular elements positioned orthogonal to one another and coplanar with the third pair of triangular elements; and the third and fourth pair of triangular elements positioned on a side of the six sided structure opposite the selected surface.

6. The apparatus of claim 5 further comprising:

an impedance disposed between at least two adjacent sides of the six sided structure and/or a selected side of the six sided structure and a selected one of the triangular elements of the third or fourth pair of elements.

7. The apparatus of claim 1 wherein the vertical coupling element is positioned at or near an electric field null of the triangular elements provided by the first and second pair of elements.

8. The apparatus of claim 7 further comprising:

a coaxial cable connected to the vertical coupling element and further disposed adjacent a center of a ferrite core to provide a vertically polarized feed for the antenna.

9. The apparatus of claim 1 wherein said the first and second triangular elements are each fed to respective portions of the phasing module from a point near where the triangular elements meet on the selected surface.

10. The apparatus of claim 1 wherein:

the first combined signal and a negative of the second combined signal are further combined at an offset of 90 degrees from one another to produce a first (W) and second (E) line of sight (LOS) beam with horizontal polarization, and a compliment of the first combined signal and the combined signals are combined with an offset of 90 degrees from one another to produce a third (N) and fourth (S) LOS beam with horizontal polarization.

11. The apparatus of claim 1 and further wherein:

the first combined signal is further combined at 90° with the center feed signal to produce a first (W) and second (E) beam; and the second combined signal is further combined with the center feed signal to produce third (N) and fourth (S) beam.

12. An antenna comprising:

two or more radiating elements disposed on a first surface and co-planar with each other;

a three dimensional support structure with the two or more radiating elements disposed on a first surface of the three dimensional support structure, and including at least one side surface being disposed adjacent and perpendicular to the first surface;

a vertical coupling element disposed within the support structure, arranged to parasitically feed the at least one side surface that is disposed perpendicularly to the first surface having the radiating elements; and a phasing module for selectively combining the plurality of radiating elements for at least two polarization modes, with a first element of each pair providing a first combined signal, and with a second element of each pair providing a second combined signal, and such that in a first polarization mode, and the first and second combined signal being further combined at an offset of 90 degrees from one another to provide a circularly polarized feed, and such that in a second polarization mode, the first and second combined signals are further combined together to provide a vertically polarized feed.

13. The antenna of claim 1 wherein the vertical coupling element is positioned at or near an electric field null of the radiating elements.

14. The antenna of claim 13 further comprising:

a coaxial cable connected to the vertical coupling element and further disposed adjacent a center of a ferrite core to provide a vertically polarized feed.

* * * * *

UNITED STATES PATENT AND TRADEMARK OFFICE

CERTIFICATE OF CORRECTION

PATENT NO. : 8,988,303 B1
APPLICATION NO. : 13/404626
DATED : March 24, 2015
INVENTOR(S) : John T. Apostolos et al.

It is certified that error appears in the above-identified patent and that said Letters Patent is hereby corrected as shown below:

In The Claims

Claim 13, Col. 8, line 28 should read:
13. The antenna of claim 12 wherein the vertical coupling Signed and Sealed this
Twenty-second Day of September, 2015

Michelle K. Lee

Michelle K. Lee
*Director of the United States Patent and Trademark Office*